United States Patent [19]

Reumann

[11] Patent Number: 4,891,963

[45] Date of Patent: Jan. 9, 1990

[54] WIRE ROD ROLLING MILL

[75] Inventor: Manfred Reumann, Neuss-Wulmstorf, Fed. Rep. of Germany

[73] Assignee: Hamburger Stahlwerke GmbH, Hamburg, Fed. Rep. of Germany

[21] Appl. No.: 239,213

[22] Filed: Aug. 31, 1988

[30] Foreign Application Priority Data

Sep. 12, 1987 [DE] Fed. Rep. of Germany ..... 3730745

[51] Int. Cl.[4] ..... B21B 1/00

[52] U.S. Cl. ..... 72/203; 72/132

[58] Field of Search ..... 72/203, 132; 83/907; 242/79, 82

[56] References Cited

U.S. PATENT DOCUMENTS

| | | | |
|---|---|---|---|
| 4,176,535 | 12/1979 | Elsner et al. | 72/203 X |
| 4,389,868 | 6/1983 | Strout | 72/132 OR |
| 4,494,395 | 1/1985 | Brettbacher et al. | 72/203 OR |

FOREIGN PATENT DOCUMENTS

| | | | |
|---|---|---|---|
| 0016705 | 5/1977 | Japan | 72/203 |
| 0801991 | 2/1981 | U.S.S.R. | 72/203 |

*Primary Examiner*—Howard N. Goldberg
*Assistant Examiner*—Trene Cuda
*Attorney, Agent, or Firm*—Herbert Dubno

[57] ABSTRACT

The wire rolling mill has a plurality of roughing stands, a cropping shears, a finishing block, a coiler with a coiler pipe and a coiler drive including a coiler motor and a coiler gear unit and a delivery conveyor for the finished wire deposited in coils. The wire rolling mill also has a controller with a computer which controls the cropping shears with a predetermined rolling program by a computer shear command. The cropping shears cuts away a cropped length from the rolled wire rod workpiece prior to entry in the finishing block defined in the computer shear command thus producing a wire head to be deposited in coils. The cropped length of the wire is put in line with the position of the coiler. The coiler is provided with a rotation angle position transmitter operating with digital pulses which is connected with the controller and whose angular position corresponds to the coiler pipe positions. The controller combines the computer shear command and the digital pulses by an electronic AND-circuit into a shear positioning command and the cropping shears responds to the shear positioning command.

7 Claims, 2 Drawing Sheets

WIRE ROD ROLLING MILL

Field of the Invention

My present invention relates to a wire rod rolling mill and, more particularly, to a rod rolling mill having cropping shears and a coil-laying pipe forming part of a coil-laying cone or the like.

BACKGROUND OF THE INVENTION

A wire rod rolling mill generally comprises a plurality of roughing stands, a cropping shears, a finishing block, a coiler (e.g. a coil-laying cone) with a coiler pipe (e.g. a coil-laying pipe) and a coiler with a coiler pipe and a coiler drive comprising a coiler motor and a coiler gear unit and a delivery conveyor for the coils of wire or rod.

The previously mentioned components of the wire rod rolling mill are arranged in succession in the wire running direction and the wire rod rolling mill can also be provided with a controller which incorporates a computer. The computer controls the cropping shears according to a predetermined rolling program by a computer showing command and the shearing unit cuts away a cropped length according to the computer shear command from the leading end of a rolled wire rod workpiece upstream of the entrance of the rolled wire rod workpiece into the finishing block (i.e. the finishing mill with a multiplicity of mill stands) and thereby produces the wire head in a wire to be deposited in a coil and the cropped length is described. As expressly emphasized once more the shearing unit ahead of the finishing block cuts off the leading end of the rod before it enters the coil-laying pipe. The delivery conveyor chiefly comprises a plurality of parallel traction elements. It can also be constructed as a roller bed.

A wire rolling mill in which the cropped length is not correlated with the position of the coiler pipe, can operate with high rolling speed The separation of a cropped length upstream of the finishing block is required in this wire rolling mill because the leading end of the rolled wire rod workpiece which leaves the roughing stands has nonuniformities which shorten the life of the rolls or the caliber or sizing elements in the finishing block.

On the other hand there is a danger that the wire head provided to the delivery conveyor uncontrollably from the coiler can not be deposited without problems. That can lead to a completed rolled wire rod workpiece which can not be assembled into bundles and must be discarded as waste.

To avoid such problems, it was necessary, in the past, to have an operator at the coiler who can grasp the wire head with a tool and coil it so that a problem-free fanning out of the finished wire in distinct coil turns can be ensured In investigations which are not part of the known state of the art, a computer for the computer shear command allowed for a time interval in which according to the size of the spacing between the cropping shears preceding the finishing block and the coiler the speed of the wire and the coiler pipe position is fixed and is selected so that the wire head can enter into a coiler pipe position sector on the delivery conveyor in which according to experience a trouble-free coiling and deposition of the wire head can be effected.

One should also consider the prior experiences described in German Patent No. 20 38 747 which were obtained in rolling mills with substantially slower roll speed in which the shearing unit could be positioned to the rear of the finishing block. In attempts to use the rolling mills which are known with a high roll speed the described problems occur in a statistical distribution. That is because of the statistical variations of parameters which the program with which the computer operates cannot allow for.

OBJECTS OF THE INVENTION

It is an object of my invention to provide an improved wire rolling mill in which the previously described problems, especially the statistical distribution problems or variations in product quality, can no longer occur.

SUMMARY OF THE INVENTION

According to my invention the wire coiler has a rotation angle position transmitter operating with a plurality of pulses, which is connected with the controller and whose angular position corresponds to the coiler pipe position.

The controller combines the computer shear command and digital pulses of a presettable coiler pipe position sector into a shear positioning command and the cropping shears is connected to respond to the shear positioning command.

According to the position of the coiler pipe the shear positioning command can be a direct command or a delayed command.

In the already-mentioned wire rolling mill (German Patent No. 20 38 747) with roll speed substantially less than modern wire rolling mills one has a signal generator located at the coiler pipe which detects the position of the coiler pipe and this signal generator is connected by a timing circuit to a controller for the shearing unit located upstream of the finishing rolls which can be stopped for certain quadrants of the coiler. The object of my invention cannot be attained with such a timing circuit and signal generator. Generally the coiler drive is provided directly with the rotation angle position transmitter. According to an advantageous embodiment of my invention, however the rotation angle position transmitter or position generator is mounted on a shaft of the coiler drive with an intervening adapter gear unit so that the adapter drive translates exactly the position of the rotation angle position transmitter or position generator and the coiler, including a null position.

To operate with a very exact high resolution coiler pipe position sectors one embodiment of my invention operates with a rotation angle position transmitter or position generator from which a definite null pulse and 360 equal-spaced pulses for each complete rotation are obtainable.

A particularly high resolution is obtained by integral multiples of the 360 equal-spaced pulses.

In one embodiment having an operating simplicity a counter is positioned between the rotation angle position transmitter and the electronic AND-circuit (AND gate or AND logic) and the counter is equipped with a preselecting device with which the predeterminable coiler pipe position sectors and the sector widths are adjustable or can be set. The counter can be set to null (zero) with added numbers or to a predetermined resettable value after each complete rotation of the rotation angle position transmitter. The preselecting device appropriately divides each complete revolution of the rotation angle position transmitter, and thus the coiler pipe, into a predetermined number of coiler pipe position sectors so that the sector width is variable with increasing wire thickness.

In the wire rolling mill according to my invention for all wire thicknesses to be controlled on starting it can be ascertained visually in which coiler pipe position sectors the wire head of a new rolled wire rod workpiece after removal of the cropped length must enter so that a properly coiled and trouble-free deposition on the delivery conveyor occurs. With this information the design or structure is such that the controller is subjected to the computer shear command and the digital pulses of the coiler pipe position sectors for the AND-circuit and the cropping shears consequently perform the top shearing at the correct moment.

The attained advantages of my invention are that in my wire rolling mill the above-described problems an especially the problems arising from statistical factors no longer occur.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
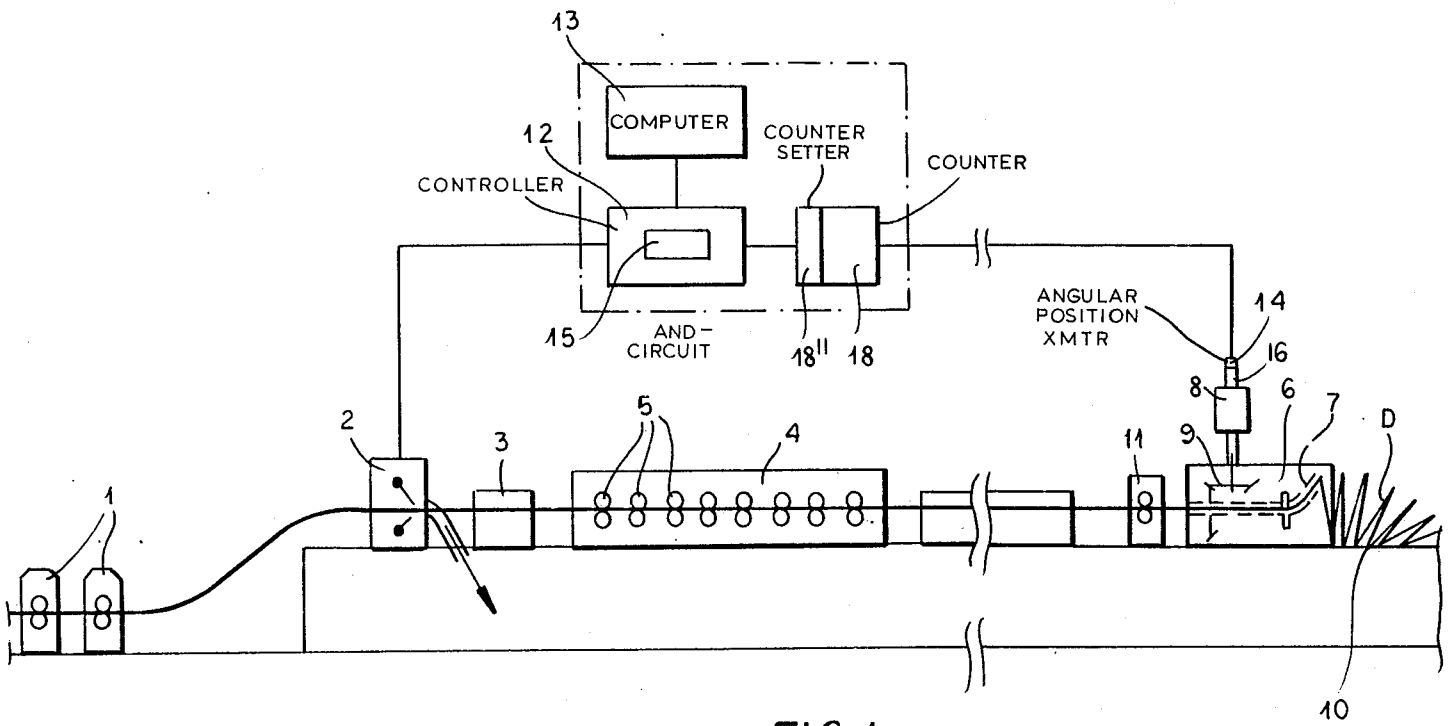
FIG. 1 is a schematic diagram of a wire rolling mill according to my invention.

The rolling mill of the drawing is equipped with a plurality of roughing stands 5, a shearing unit 2, a finishing block 4 with eight finishing stands 5, a coiler 6 with a coiler pipe 7 and a coiler drive comprising a coiler motor 8 and a coiler gear unit 9 and a delivery conveyor 10 for the wire D to be rolled in coils.

Only the last two stands of the roughing mill 1 are shown.

A cooling region is located between the finishing block 4 and coiler 6.

A drive stand 11 is connected just upstream of the coiler 6.

The wire rolling mill has a controller 12 with a computer 13. The computer 13 controls the shearing unit 2 according to a predetermined rolling program by a computer shear command.

The cropping shears 2 cuts away a cropped length according to the computer shear command from the leading end of the rolled wire rod workpiece prior to feeding it to the finishing block 4. Thereby the wire head of the wire D wound in a coil is produced.

The cropped length is accommodated to the position of the coiler pipe 7. The cutaway top portion is thrown away and disposed of as indicated in FIG. 1 by the arrow under the shearing unit 2.

Figure 2:
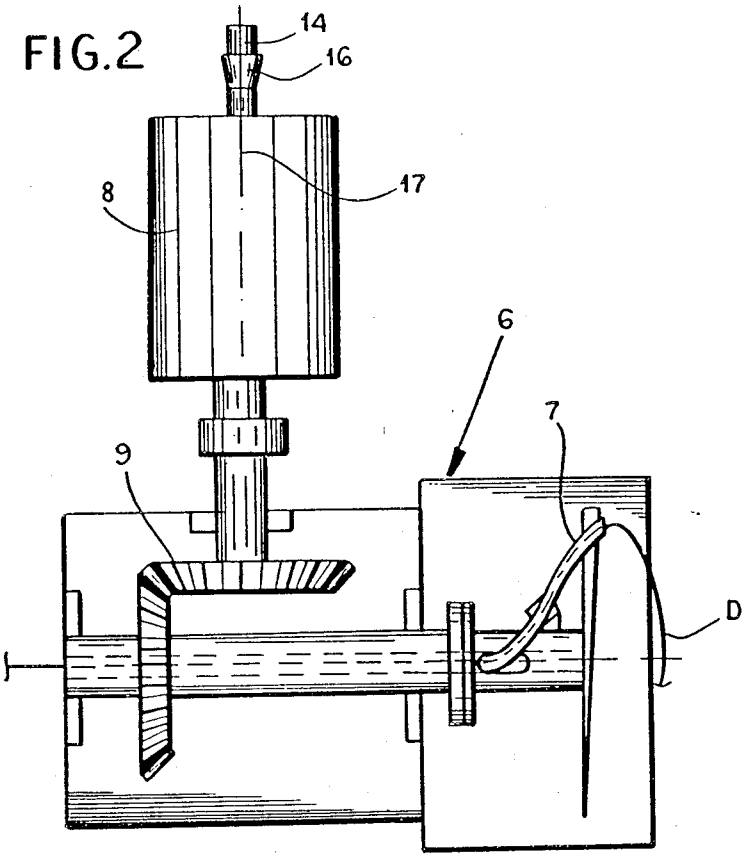
FIG. 2 is a detailed side view of components of the wire rolling mill shown in FIG. 1 related to the coiler and the rotation angle position transmitter.

The coiler 6 has, as is indicated in FIG. 2, a rotation angle position transmitter 14 operated with digital pulses which is connected with the controller 12. The angular orientation of the rotation angle position transmitter 14 corresponds to the position of the coiler pipe 7. The controller 12 combines the computer shear command and the digital pulses for a presettable coiler pipe position sector S by an electronic AND-circuit 15 into the shear positioning command. The cropping shears responds next to the shear positioning command.

In this example and according to an advantageous embodiment of my invention the rotation angle position transmitter 14 is mounted on a shaft 17 of the coiler drive with an intervening adaptor gear 16. The adapter gear 16 corresponds mathematically precisely to the coiler gears. The mill is designed so that the adaptor gear 16 synchronizes the positions of the rotation angle position transmitter 14 and coiler pipe 7, including a null position.

A definite null pulse and 360 equal-spaced pulses for each complete rotation may be obtained from the rotation angle position transmitter. A counter 18 which resets itself after each complete rotation of the rotation angle position transmitter 14 and thus coiler pipe 7 is located between the rotation angle position transmitter 14 and the electronic AND-circuit 15 so that the counter 18 is equipped with a preselecting device 18'' with which the presettable coiler pipe position sector S and the sector width B are selectable.

The preselecting device 18'' divides each complete rotation of the rotation angle position transmitter 14 and thus the coiler pipe 7 into a predetermined number of coiler pipe position sectors. The sector width B is variable along with the increasing wire thickness.

Figure 3:
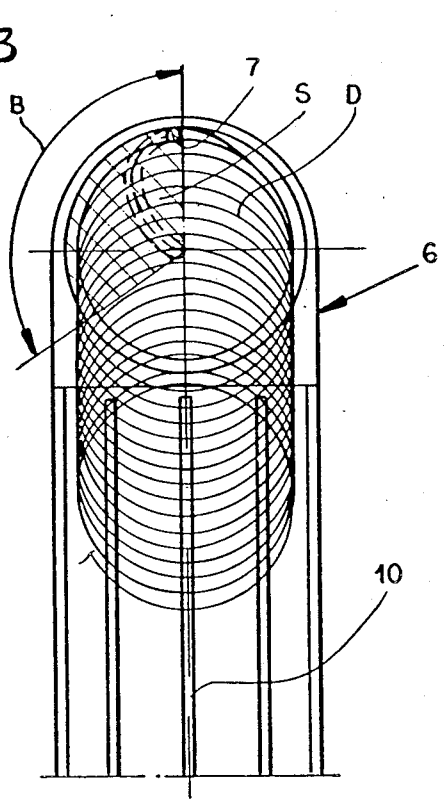
FIG. 3 a detailed top plan view of the delivery conveyor of the wire rolling mill with parts of the coiler.

The coiler position sectors, from which the wire head must issue so that depositing a single rolled wire rod workpiece can occur without problem, are set during preparation of the wire rolling mill. In FIG. 3 one such coiler pipe position sector S is indicated. The sector width B also observable there is selected differently according to the wire thickness, so that it can be operated continuously with reduced sheared top portion length. The values once fixed are independent of the rolling mill speed, but change themselves somewhat of course in the course of time because of gauge wear. The corrections required can be performed without difficulty by changing the position of the coiler pipe position sectors in circuit and/or increasing of the sector width B.

I claim:

1. A wire rolling mill for making wire comprising a plurality of roughing stands, a cropping shears, a finishing block, a coiler with a coiler pipe and a coiler drive comprising a coiler motor and a coiler gear unit, a delivery conveyor for said wire which has been completely rolled into coils, said roughing stands, said cropping shears, said finishing block, said coiler and said delivery conveyor being arranged in succession in the wire running direction, and also comprising a controller with a computer, in which said computer controls said shearing unit defined in a predetermined rolling program by a computer shear command and said shearing unit cuts away a cropped length defined in said computer shear command from the leading end of a rolled wire rod workpiece prior to feeding said rolled wire rod workpiece to said finishing block, and thereby produces a wire head of said wire deposited in a coil, said cropped length being correlated with the coiler pipe, position, said wire coiler having a rotation angle position transmitter operating with a plurality of digital pulses, which is connected with said controller and whose angular position corresponds to said coiler pipe position, said controller combining said computer shear command and said digital pulse of a presettable coiler pipe position sector by an electronic AND-circuit into a shear positioning command and said cropping shears responds to said shear positioning command.

2. The improvement defined in claim 1 wherein said coiler drive has said rotation angle position transmitter.

3. The improvement defined in claim 2 wherein said rotation angle position transmitter is mounted on a shaft of said coiler drive with an intervening adaptor gear unit and said adaptor gear unit translates the positions of said rotation angle position transmitter and said coiler pipe, including a null position.

4. The improvement defined in claim 1 wherein a definite null pulse and 360 equal-spaced pulses for each complete rotation are obtainable from said rotation angle position transmitter.

5. The improvement defined in claim 4 wherein a counter is positioned between said rotation angle position transmitter and, said electronic AND-circuit and said counter is equipped with a preselecting device with which the presettable coiler pipe position sector and the sector width are adjustable.

6. The improvement defined in claim 5 wherein said preselecting device divides each complete rotation of said rotation angle position transmitter into a predetermined number of said coiler pipe position sectors and said sector width is variable with increasing wire thickness.

7. A Wire rolling mill comprising:

a plurality of roughing stands;

a cropping shears;

a finishing block;

a coiler with a coiler pipe and a coiler drive comprising a coiler motor and a coiler gear unit;

a delivery conveyor for said wire which has been completely rolled into coils, said roughing stands, said cropping shears, said finishing block, said coiler and said delivery conveyor;

a controller having a computer controlling said shearing unit defined in a predetermined rolling program by a computer shear command, said shearing unit cutting away a cropped length defined in said computer shear command from the leading end of a rolled wire rod workpiece prior to feeding said wire strand into said finishing block, and thereby producing a wire head of said wire deposited in a coil and said, cropped length being correlated with the coiler pipe position;

a rotation angle position transmitter for said coiler operating with a plurality of pulses, which is connected with said controller whose angular position corresponds to said coiler pipe position so that said controller combines said computer shear command and said digital pulses of a predetermined coiler pipe position sector by an electronic AND-circuit for a shear positioning command and said cropping shears responds to said shear positioning command, said rotation angle position transmitter being mounted on a shaft of said coiler drive with an adaptor gear unit intervening and said adaptor gear unit reproducing the positions of said rotation angle position transmitter and said coiler pipe, including a null position, a definite null pulse and 360 equal-spaced pulses for each complete rotation being obtainable from said rotation angle position transmitter; and a counter positioned between said rotation angle position transmitter and said electronic AND-circuit equipped with a preselecting device with which the presettable coiler pipe position sector and sector width are adjustable.

* * * * *